US007839427B2

(12) United States Patent
Ono

(10) Patent No.: US 7,839,427 B2
(45) Date of Patent: Nov. 23, 2010

(54) MULTI-BEAM IMAGE FORMING APPARATUS CONFIGURED TO PERFORM DROOP CORRECTION

(75) Inventor: Katsuhiro Ono, Ibaraki (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 12/369,970

(22) Filed: Feb. 12, 2009

(65) Prior Publication Data

US 2009/0219377 A1 Sep. 3, 2009

(30) Foreign Application Priority Data

Feb. 29, 2008 (JP) ..... 2008-050171

(51) Int. Cl.
*B41J 2/435* (2006.01)

(52) U.S. Cl. ..... 347/236; 347/246

(58) Field of Classification Search ..... 347/128, 347/133, 236–240, 246, 247, 251–255
See application file for complete search history.

(56) References Cited

U.S. PATENT DOCUMENTS 5,959,655 A * 9/1999 Maruo et al. ..... 347/246
7,554,574 B2 * 6/2009 Shoji et al. ..... 348/207.99
2005/0146597 A1 * 7/2005 Seto ..... 347/246
2007/0176864 A1 * 8/2007 Chino ..... 345/82

FOREIGN PATENT DOCUMENTS

| | | |
|---|---|---|
| JP | 9-314908 | 12/1997 |
| JP | 2001-105654 | 4/2001 |
| JP | 2002-86793 | 3/2002 |
| JP | 2003-127454 | 5/2003 |
| JP | 2007-1151 | 1/2007 |
| JP | 2007-30360 | 2/2007 |

* cited by examiner

*Primary Examiner*—Hai C Pham
(74) *Attorney, Agent, or Firm*—Oblon, Spivak, McClelland, Maier & Neustadt, L.L.P.

(57) ABSTRACT

A multi-beam image forming apparatus is disclosed in which a semiconductor laser array including plural semiconductor laser elements serves as an optical beam generation unit. The apparatus includes a printing ratio counting unit that counts printing ratios of the semiconductor laser elements in plural printing areas divided in a scanning direction based on image data transmitted from a host unit; and a light amount control unit that controls emission light amounts of the semiconductor laser elements based on a result from the printing ratio counting unit. The light amount control unit calculates droop correction values corresponding to the printing areas from the printing ratios of the semiconductor laser elements based on the printing ratios in the printing areas counted by the printing ratio counting unit so as to correct the light amounts of the semiconductor laser elements.

6 Claims, 8 Drawing Sheets

FIG.7

| | AREA 1 | AREA 2 | AREA 3 | AREA 4 |
|---|---|---|---|---|
| CH1 | 20% | 100% | 10% | 0% |
| CH2 | 10% | 20% | 20% | 0% |
| CH3 | 50% | 30% | 40% | 10% |
| CH4 | 0% | 10% | 30% | 100% |
| CH5 | 0% | 10% | 40% | 50% |
| ▪ | ▪ | ▪ | ▪ | ▪ |
| ▪ | ▪ | ▪ | ▪ | ▪ |
| ▪ | ▪ | ▪ | ▪ | ▪ |
| CH19 | 10% | 40% | 100% | 60% |
| CH20 | 5% | 0% | 20% | 30% |
| TOTAL | 1000% | 550% | 1600% | 1000% |

FIG.8A

| ELEMENT PRINTING RATIO (%) | CORRECTION VALUE |
|---|---|
| 0 TO 25 | Pw |
| 25 TO 50 | Px |
| 50 TO 75 | Py |
| 75 TO 100 | Pz |

300

FIG.8B

| TOTAL PRINTING RATIO (%) | CORRECTION VALUE |
|---|---|
| 0 TO 500 | Pa |
| 500 TO 1000 | Pb |
| 1000 TO 1500 | Pc |
| 1500 TO 2000 | Pd |

310

| AREA | ACCUMULATIVE PRINTING RATIO IN PREVIOUS AREA | AREA CORRECTION COEFFICIENT |
|---|---|---|
| 2 | 0 TO 2000% | K1 |
| 3 | 2000 TO 4000% | K2 |
| 4 | 4000 TO 6000% | K3 |

320

MULTI-BEAM IMAGE FORMING APPARATUS CONFIGURED TO PERFORM DROOP CORRECTION

BACKGROUND OF THE INVENTION

1. Field of the Invention

The present invention relates to droop correction for laser elements generated during image formation in a multi-beam image forming apparatus that forms images using plural semiconductor laser elements serving as an optical beam generation unit.

2. Description of the Related Art

In electrophotographic apparatuses such as laser printers and digital copiers, electrostatic latent images corresponding to recording information are formed by an optical beam generation unit using laser beams after a photoconductive drum is uniformly charged. Then, the electrostatic latent images are developed with toner and transferred onto a sheet by a transfer unit and further fixed so as to form images.

FIG. 1 shows the schematic configuration of a multi-beam image forming apparatus. A photosensitive drum 700, on which a toner image is to be formed, is uniformly charged by a charging unit 701 and then exposed to a laser beam from an optical scanning unit 702 modulated by image data transmitted from a host unit 707. Accordingly, an electrostatic latent image is formed on the photosensitive drum 700. Next, the latent image on the photosensitive drum 700 is developed by a development unit 703 to form a toner image. The toner image formed on the photosensitive drum 700 is transferred onto a print sheet 708 by a transfer unit 704. The print sheet 708 onto which the toner image is transferred is conveyed to a fixing unit 705 where the toner image is fixed on the print sheet 708. Furthermore, the remaining toner on the photosensitive drum 700, which has not been transferred onto the print sheet 708 by the transfer unit 704, is removed by a cleaning unit 706.

Conventionally, as an image forming apparatus of this type, a multi-beam image forming apparatus has been proposed that scans plural lines at the same time with plural laser beams through a polygon mirror or the like to form an image. Such a multi-beam image forming apparatus has the characteristic of performing high-speed image formation using a polygon motor that rotates at low speed and a low-power semiconductor laser because it forms a plural-line image using one surface of a polygon mirror.

In order to generate multi beams, some methods are known. According to one method, plural semiconductor lasers are optically synthesized together to generate plural laser beams. Furthermore, a method using a semiconductor laser array is known in which plural semiconductor laser elements are arranged in series so as to be packaged. Furthermore, a method using a surface light-emission laser is known in which plural semiconductor laser elements are two-dimensionally arranged so as to be packaged. Among the above methods, the method in which the plural lasers are optically synthesized together causes a complex configuration due to accuracy in scanning positions and further generation of multi beams. The method using the laser array is advantageous in terms of accuracy in the arrangement of the semiconductor laser elements as multi beams are further generated. However, the semiconductor laser array itself generates heat due to the heat generated when the respective semiconductor laser elements emit light because it is constituted by the plural semiconductor laser elements. As a result, the emission light amounts of the respective semiconductor laser elements may be varied. This phenomenon is called droop.

FIG. 2 shows an example of the variation in the light amount due to the droop. The light amount of the semiconductor laser element is set to a basic light amount $P_0$ used in an image forming range by an APC (Auto Power Control) circuit as a known art. When solid printing having a toner covering rate of 100% is performed as shown in FIG. 2, the semiconductor laser element continuously emits light. Therefore, the heat generation amount of the semiconductor laser element is increased. Due to this large self heat generation, the actual light amount gradually reduces relative to the light amount $P_0$ set by the APC (droop phenomenon). Therefore, the variation in the light amount $\Delta P$ is generated between scanning start and finish points, which results in degradation in image quality due to density irregularities.

As an example for correcting the droop, Patent Document 1 pays attention to specific pixels to be printed and generates a light-emission-level correction signal based on the light emission time of a semiconductor laser and the previous n pixel data.

Patent Document 1: JP-A-9-314908

However, this correction method requires an extremely high-speed and high-performance calculation unit because it performs a calculation in which a correction signal is generated for every pixel. In recent color printing and the like, the amount of print data information itself has been huge and high-speed output is now being demanded. Therefore, the above method is not necessarily practical from the viewpoint of cost performance.

FIG. 3 shows an example of the variation in the light amount due to the droop in a semiconductor laser array. Here, a 5-channel optical scanning unit is employed that scans image data by using a 5-element semiconductor laser array in which five semiconductor laser elements are one-dimensionally arranged in series. As shown in FIG. 3, attention is paid to the variation in the light amount of the semiconductor laser element corresponding, for example, to a CH (channel) 3. The light amount of the semiconductor laser element of the CH 3 is set to the light amount $P_0$ by the APC, which becomes the light amount of CH3 used in an image forming range.

In the image forming range, the semiconductor laser element of the CH3 emits light at the light amount P based on image data. With the self heat generation of the semiconductor laser element of the CH3, the semiconductor laser array generates heat, which results in the gradual reduction of the light amount of the semiconductor laser element of the CH3 (as shown in dotted lines in FIG. 3). When the semiconductor laser elements of a CH2 and a CH4 emit light after a predetermined time elapses, the heat generation amount of the semiconductor laser array is further increased while the light amount of the semiconductor laser element of the CH3 continues to be reduced. Then, when a CH 1 and a CH 5 emit light, the light amount of the CH3 is further reduced. At last, the light amount of the CH3 is reduced by an amount of $\Delta P1$ relative to the light amount $P_0$, and printing per scanning is completed. Due to this large light-amount variation, a variation in image density is caused in the image forming range.

The above-described droop is related to the light emission time of the respective semiconductor laser elements, and its influence becomes the greatest when the respective semiconductor laser elements continuously emit light. Besides the continuous light emission, the accumulation of the light emission time leads to the accumulation of heat even when the emission/extinguishment of light is repeatedly performed. In this case also, the influence due to the droop is caused.

FIG. 4 schematically shows an example of an image pattern in which the influence due to the droop is easily caused. When image data in which solid printing and dots are continuously formed at the first scanning are printed, a laser light amount is reduced due to continuous light emission in a solid printing region as described above. Therefore, when the dots are printed at a region (a), it is not possible to perform printing with a predetermined light amount, and as a result, printed dots would become less dense. Furthermore, when the dots are printed at a region (b) where light is not first emitted at the next scanning, it is possible to perform printing with the predetermined light amount. As a result, density irregularities are caused at the dots due to a difference in density between the dots after the continuous light emission is performed at the solid printing region and the dots next to a non-printing region, which in turn causes degradation in image quality.

SUMMARY OF THE INVENTION

According to an aspect of the present invention, there is provided a multi-beam image forming apparatus in which a semiconductor laser array including plural semiconductor laser elements serves as an optical beam generation unit. The apparatus includes a printing ratio counting unit that counts printing ratios of the semiconductor laser elements in plural printing areas divided in a scanning direction based on image data transmitted from a host unit; and a light amount control unit that controls emission light amounts of the semiconductor laser elements based on a result from the printing ratio counting unit. The light amount control unit calculates droop correction values corresponding to the printing areas from the printing ratios of the semiconductor laser elements based on the printing ratios in the printing areas counted by the printing ratio counting unit so as to correct the light amounts of the semiconductor laser elements.

According to an embodiment of the present invention, the printing ratios of the semiconductor laser elements for each of the printing areas during image formation are counted, and variations in the light amounts due to heat at the emission of the semiconductor laser elements are corrected with predetermined correction coefficients in accordance with the data of the printing ratios. In this manner, the emission light amounts of the semiconductor laser elements during the image formation are controlled. Therefore, it is possible to reduce density irregularities in scanning to suppress degradation in image quality. In addition, it is possible to correct the light amounts at high speed with a simple control circuit configuration.

Other objects, features and advantages of the present invention will become more apparent from the following detailed description when read in conjunction with the accompanying drawings.

BRIEF DESCRIPTION OF THE DRAWINGS

FIG. 7 is a diagram showing the data structure of a printing ratio holding unit according to the embodiment of the present invention;

FIGS. 8A through 8C are diagrams showing the configuration of an optical correction table according to the embodiment of the present invention; and FIG. 9 is a diagram showing a droop correction effect to which the embodiment of the present invention is applied.

DETAILED DESCRIPTION OF THE PREFERRED EMBODIMENTS

Next, an embodiment of the present invention is described with reference to the accompanying drawings.

Embodiment

Figure 1:
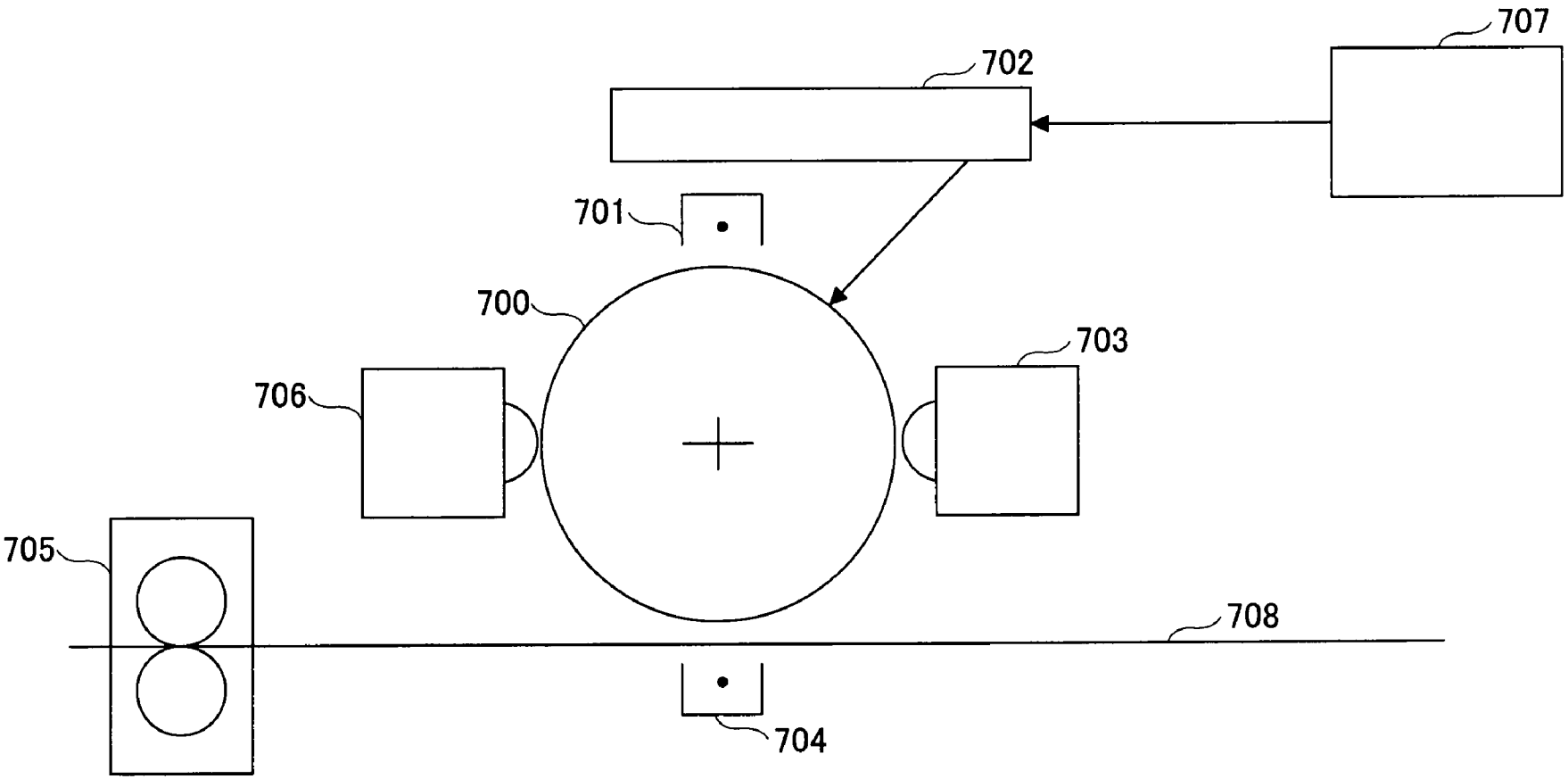
FIG. 1 shows the configuration diagram of a multi-beam image forming apparatus.
Figure 2:
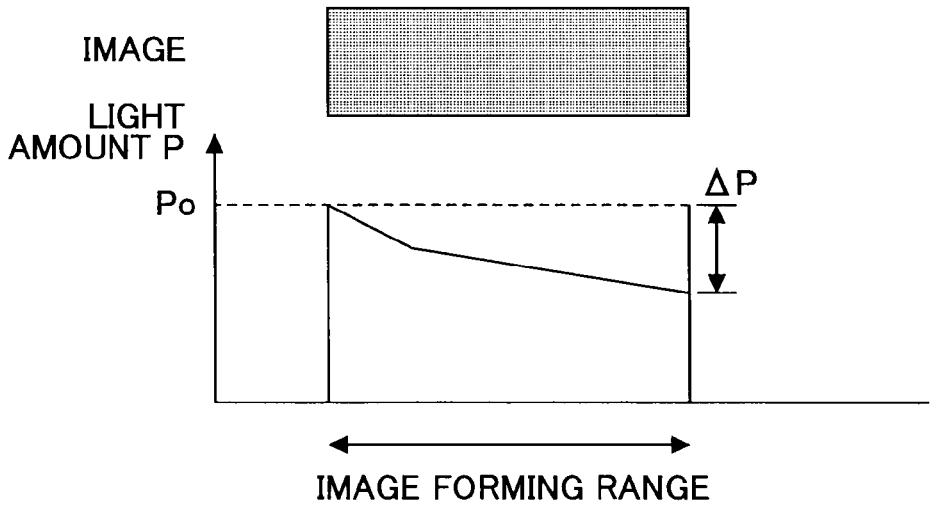
FIG. 2 is a diagram showing a variation in a light amount due to the droop.
Figure 3:
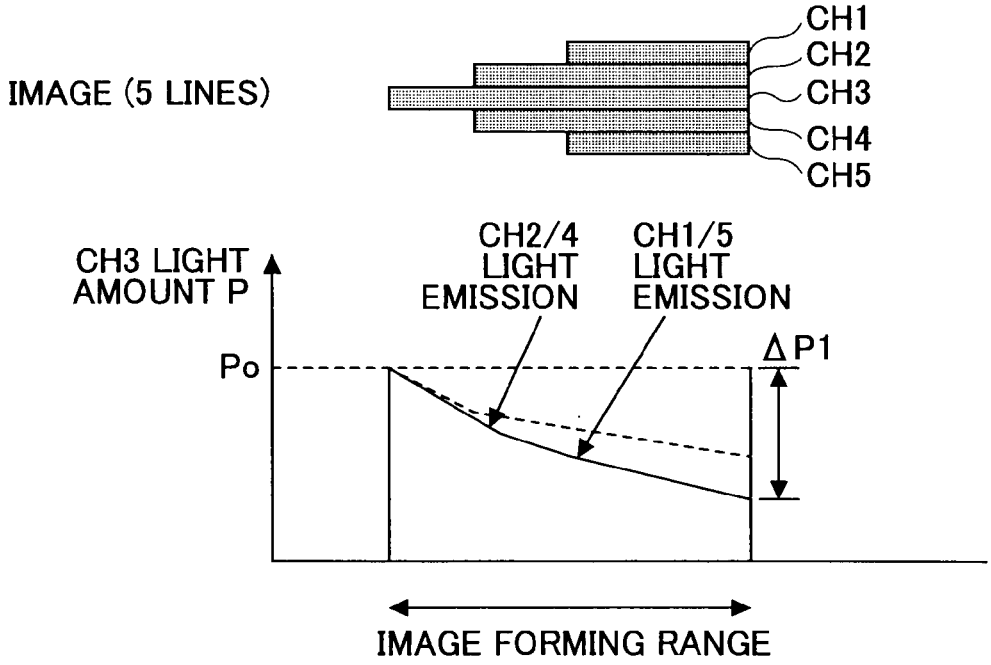
FIG. 3 is a diagram showing the variation in the light amount due to the droop in a semiconductor laser array.
Figure 4:
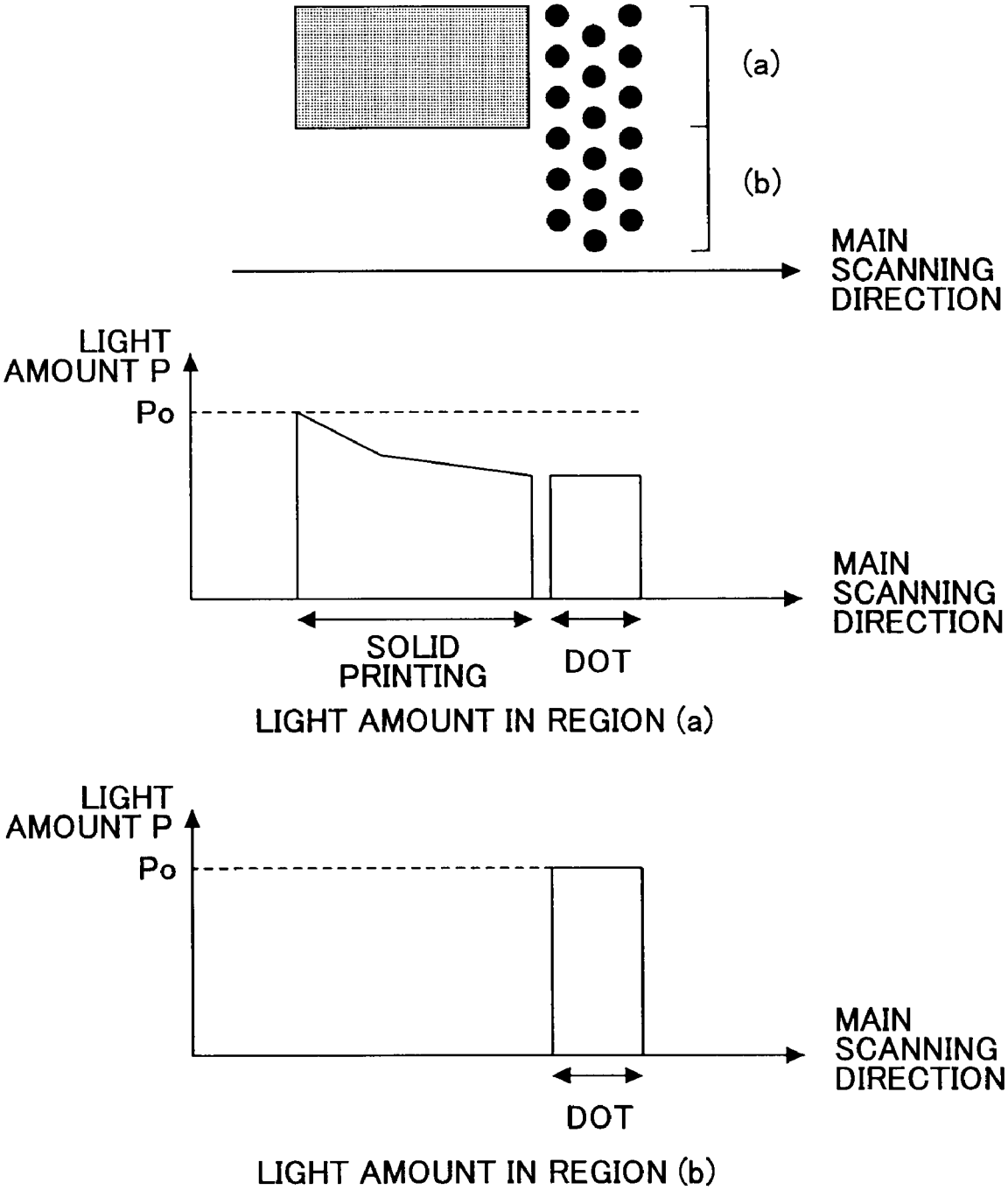
FIG. 4 is a diagram showing influences on printing quality due to the droop.
Figure 5:
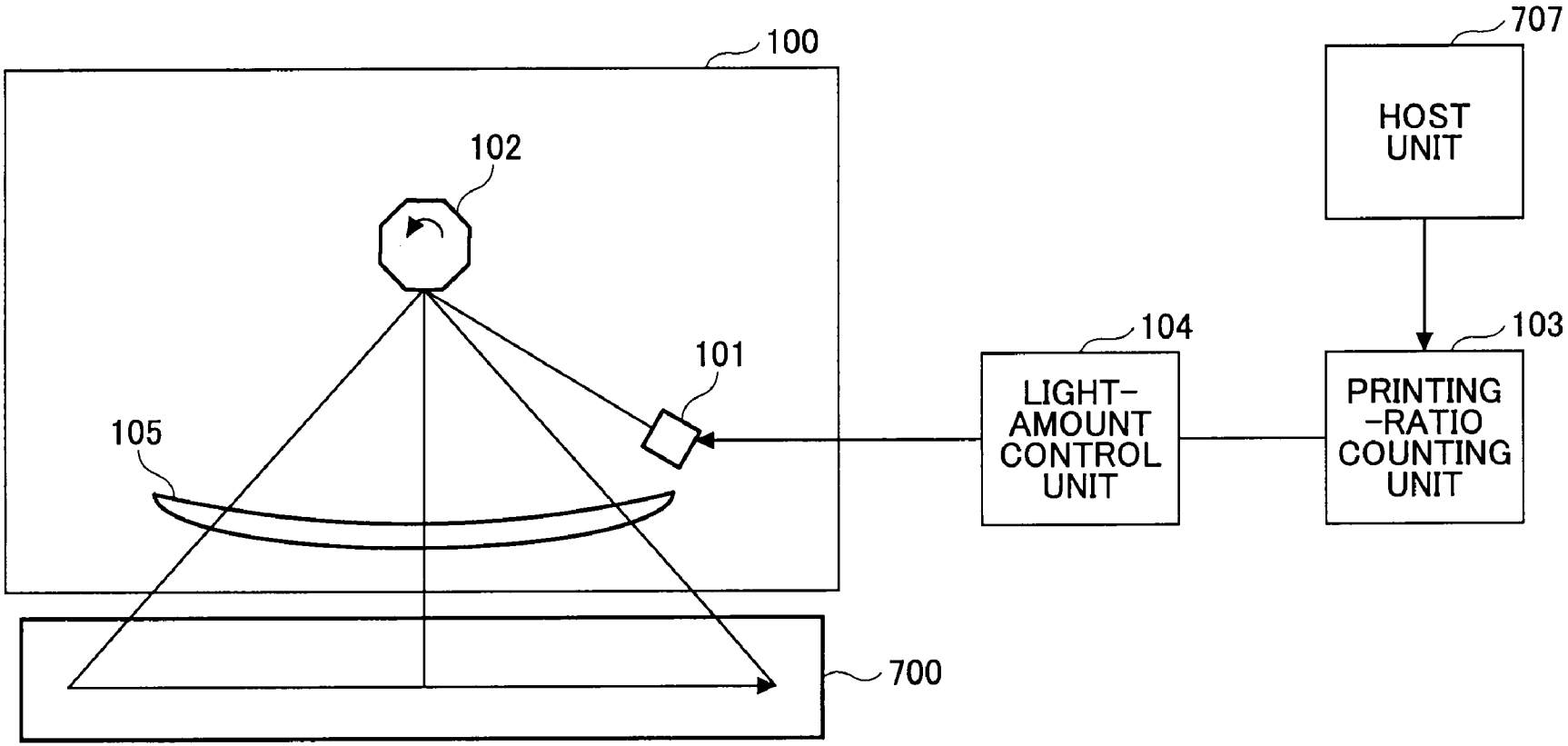
FIG. 5 is a schematic block diagram showing an embodiment of the present invention.

The embodiment of the present invention is described based on FIGS. 1 and 5 through 9. FIG. 5 shows a schematic block diagram showing the embodiment of the present invention. The embodiment includes an optical scanning unit 100 composed of an optical beam generation unit 101 and a scanning unit 102, a printing ratio counting unit 103, and a light amount control unit 104. Plural laser beams generated from the optical beam generation unit 101 are applied to the deflecting reflection surfaces of the scanning unit 102, such as a polygon mirror, and then caused to pass through an image forming unit such as an f-θ lens 105 to form an image on the photosensitive drum 700. In this manner, the surface of the photosensitive drum 700 is scanned.

In this embodiment, the optical beam generation unit 101 uses a 20-element semiconductor laser array in which 20 semiconductor laser elements are one-dimensionally arranged to generate 20 laser beams.

As described above, the droop depends on image data transmitted from the host unit 707. Therefore, this embodiment provides the printing ratio counting unit 103 that counts the printing ratios of the semiconductor laser elements and the light amount control unit 104 that determines light amount correction values according to the droops of the semiconductor laser elements to control the light amounts of the semiconductor laser elements.

Figure 6:
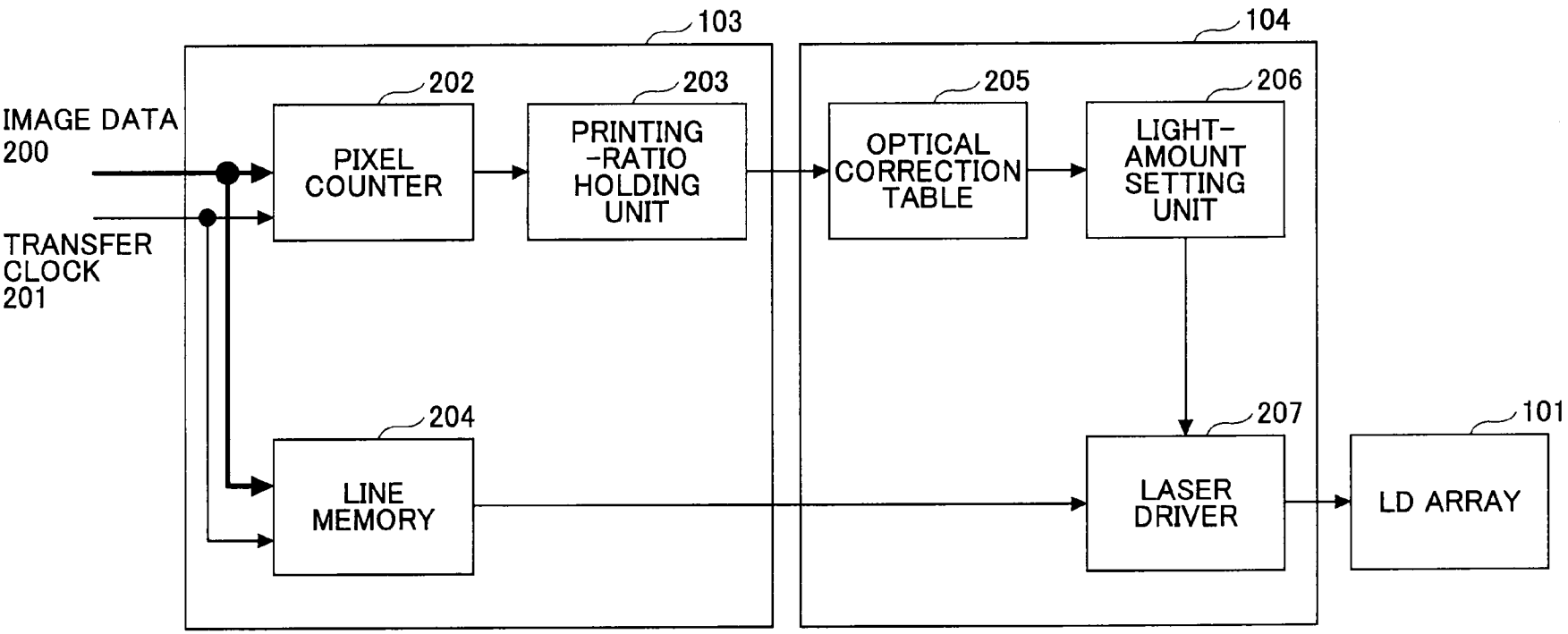
FIG. 6 is a block diagram showing the configurations of a printing ratio counting unit and a light amount control unit according to the embodiment of the present invention.

FIG. 6 shows the configurations of the printing ratio counting unit 103 and the light amount control unit 104. The printing ratio counting unit 103 is composed of a pixel counter 202, a printing ratio holding unit 203, and a line memory 204. Furthermore, the light amount control unit 104 is composed of an optical correction table 205, a light amount setting unit 206, and a laser driver 207.

The host unit 707 transmits 20-line image data 200 and a transfer clock 201 to the printing ratio counting unit 103 per scanning. The transmitted image data 200 are input to the pixel counter 202 of the printing ratio counting unit 103 where the number of pixels per scanning is counted based on the transfer clock 201. The count value counted by the pixel counter 202 is compared with the number of pixels when 100%-printing (full printing) is performed, converted into a printing ratio per scanning, and held in the printing ratio holding unit 203 until the next scanning. The printing ratio holding unit 203 divides an image forming range into plural printing areas and holds the printing ratio transmitted from the pixel counter 202 for each of the printing areas.

FIG. 7 shows an example of printing ratio holding data. The printing ratio holding unit 203 holds a printing ratio for each of the semiconductor laser elements (CH1 through CH20) in the printing areas and a total printing ratio for each of the printing areas in which the printing ratios of the respective semiconductor laser elements are summed. Accordingly, the total printing ratio for each of the printing areas could be 2000% (100%×20 semiconductor laser elements) at maximum.

On the other hand, when the image data 200 are input to the pixel counter 202, they are also input to the line memory 204 of the printing ratio counting unit 103 and sequentially written in the memory with the transfer clock 201. The written image data 200 are held in the line memory 204 until the next scanning and then sequentially read at the next scanning. At the same time, the next new image data 200 are written in the line memory 204. The above processing is performed for every scanning. The image data are delayed by an amount of one scanning and stored in the printing ratio counting unit 103 to provide processing time required for counting the printing ratio.

An output from the printing ratio holding unit 203 indicates what number of the printing area in a scanning direction and what extent image data are turned ON/OFF. In other words, a light amount correction value, which is a result obtained by counting a laser light emission amount for every printing area and stored in the optical correction table 205 of the light amount control unit 104 based on the result, is read.

Figures 8C, 9:
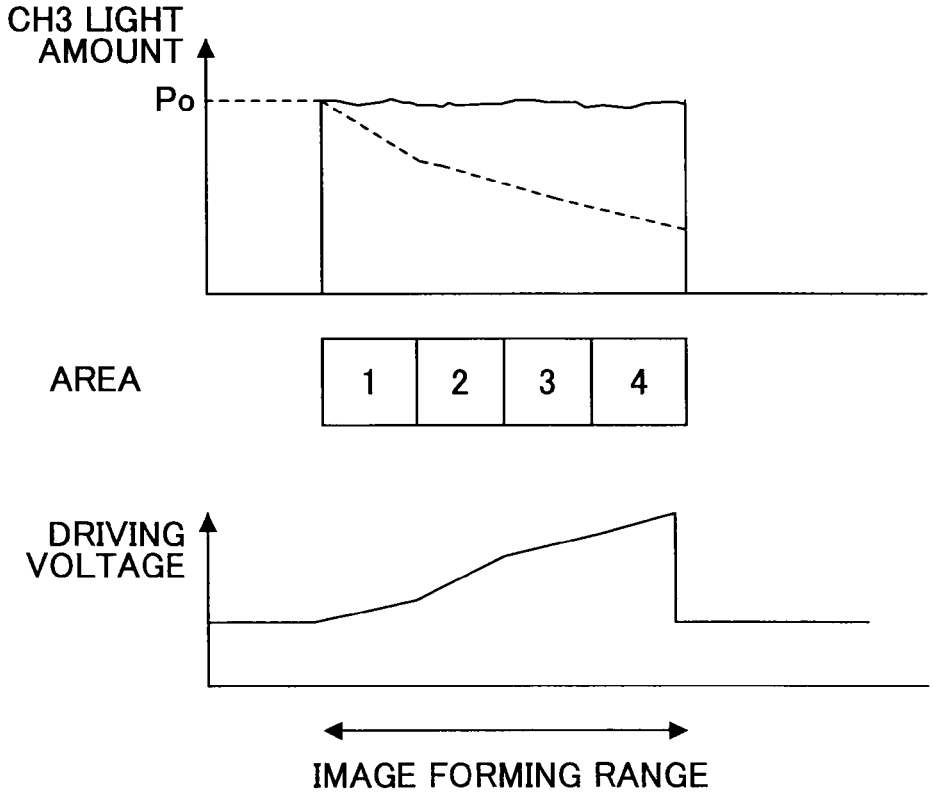

FIGS. 8A through 8C shows an example of the optical correction table 205. The optical correction table 205 includes an element correction table 300, a total correction table 310, and a printing area correction table 320 as information. The element correction table 300 determines correction values provided for the printing ratios of the semiconductor laser elements. The total correction table 310 determines correction values of the semiconductor laser elements with respect to the total printing ratios of all the semiconductor laser elements corresponding to the printing area. The printing area correction table 320 determines correction coefficients inherent in the printing areas. For example, if all the printing areas have the same printing ratio, the variation in the light amount increases from a printing area 1 toward printing areas 2, 3, and 4. In other words, the printing area correction table 320 is required because the correction values of the subsequent printing areas are changed in accordance with the accumulative printing ratios of the prior printing areas.

For example, the printing area 1 does not require the correction coefficient because there is no printing area right before the printing area 1. The printing area 2 requires the correction coefficient because its variation in the light amount depends on the total printing ratio of the printing area 1. In this embodiment, the correction coefficients of the respective printing areas are as follows.

Printing area 1: No correction coefficient

Printing area 2: K1 (the total printing ratio of the printing area 1 is 1000%)

Printing area 3: K1 (indicating the total printing ratios of the printing areas 1 and 2 because the accumulative printing ratio is 1550%)

Printing area 4: K2 (indicating the total printing ratios of the printing areas 1, 2, and 3 because the accumulative printing ratio is 3150%)

Specifically, in the case of the CH3 in the printing area 2, the printing ratio of the CH 3 is 30% which corresponds to the correction value Px, the total printing ratio in the printing area 2 is 550% which corresponds to the correction value Pb, and the printing area 2 corresponds to the correction coefficient K1. Accordingly, a correction light amount L is found according to the following formula.

$$L=K1\times(Px+Pb)$$

Based on the result counted by the printing ratio counting unit as described above, 20-element semiconductor lasers are caused to emit light with the setting value calculated by the light amount control unit 104 that controls an emission light amount. The correction values of the correction tables are determined so as to obtain optimum images based on a printing test conducted using various parameters provided in advance in an image forming apparatus.

The light amount setting unit 206 determines the driving voltage of the laser driver 207 based on the optical correction table 205 to control the emission light amounts of the semiconductor laser elements. As described above, the light amount is gradually varied. Therefore, it is required that the driving voltage of the laser driver 207 be gradually changed from the first printing area to the last printing area.

As described above, the correction light amounts of the semiconductor laser elements during image formation are determined based on the light amount correction values corresponding to the printing ratios of the semiconductor laser elements in the printing areas, the light amount correction values corresponding to the total printing ratios, and the correction coefficients corresponding to the printing areas.

Based on the result counted by the printing ratio counting unit as described above, the 20-element semiconductor laser is caused to emit light with the setting value set by the light amount control unit 104 that controls the emission light amount.

FIG. 9 shows a droop correction result to which the embodiment of the present invention is applied, focusing on the semiconductor laser element of the CH3. An image forming range is divided into four printing areas. Based on the printing ratio of the corresponding semiconductor laser element in the prior scanning and the printing ratios of all the semiconductor laser elements, the emission light amount is determined according to the optical correction table 205. The semiconductor laser element of the CH3 emits light in the light amount controlled by the APC at the beginning of the printing area 1 and gradually raises a driving voltage by the end of the printing area 1 to suppress the variation (reduction) in the light amount. Similar control is made for each of the printing areas. As a result, the emission light amount of the semiconductor laser element of the CH3 becomes constant in the image forming range, which in turn makes it possible to suppress degradation in image quality due to density irregularities. This light amount correction is also applied to the channels other than CH3 to obtain the similar effect.

Note that this embodiment uses the one-dimensionally arranged semiconductor laser array as an example, but the correction can also be applied to the two-dimensionally arranged surface light-emission laser under the similar principle. However, in the case of the surface light-emission laser, the arrangement density of laser elements is higher than that of the one-dimensionally arranged laser array. Therefore, in order to obtain an optimum printing result, a thermal effect between the respective semiconductor laser elements in accordance with the fact that the arrangement density of laser elements is higher than that of the one-dimensionally arranged laser array and correction in accordance with droop characteristics have to be taken into consideration.

The present invention is not limited to the specifically disclosed embodiments, and variations and modifications may be made without departing from the scope of the present invention.

The present application is based on Japanese Priority Application No. 2008-050171 filed on Feb. 29, 2008, the entire contents of which are hereby incorporated herein by reference.

What is claimed is:

1. A multi-beam image forming apparatus in which a semiconductor laser array including plural semiconductor laser elements serves as an optical beam generation unit, the apparatus comprising:

a printing ratio counting unit that counts printing ratios of the semiconductor laser elements in plural printing areas divided in a scanning direction based on image data transmitted from a host unit; and a light amount control unit that controls emission light amounts of the semiconductor laser elements based on a result from the printing ratio counting unit, wherein the light amount control unit calculates droop correction values corresponding to the printing areas from the printing ratios of the semiconductor laser elements based on the printing ratios in the printing areas counted by the printing ratio counting unit so as to correct the emission light amounts of the semiconductor laser elements, and wherein the light amount control unit has an optical correction table including correction values corresponding to the printing ratios of the semiconductor laser elements and correction coefficients of the printing areas and has a light amount setting unit, and the light amount setting unit calculates the droop correction values of the semiconductor laser elements corresponding to the printing areas based on information of the optical correction table.

2. The multi-beam image forming apparatus according to claim 1, wherein the light amount setting unit calculates the droop correction values of the semiconductor laser elements corresponding to the printing areas by multiplying the correction values corresponding to the printing ratios of the semiconductor laser elements by area correction coefficients of the printing areas.

3. The multi-beam image forming apparatus according to claim 1, wherein the optical correction table further has correction values corresponding to total printing ratios of the semiconductor laser elements in the printing areas, and the correction values corresponding to the printing ratios of the semiconductor laser elements corresponding to the printing areas are obtained by adding the correction values corresponding to the printing ratios of the semiconductor laser elements to the correction values corresponding to the total printing ratios of the semiconductor laser elements.

4. The multi-beam image forming apparatus according to claim 1, wherein the correction values corresponding to the printing ratios of the semiconductor laser elements are added to correction values corresponding to total printing ratios in which the printing ratios of the semiconductor laser elements are summed for each of the printing areas.

5. A multi-beam image forming apparatus in which a semiconductor laser array including plural semiconductor laser elements serves as an optical beam generation unit, the apparatus comprising:

a printing ratio counting unit that counts printing ratios of the semiconductor laser elements in plural printing areas divided in a scanning direction based on image data transmitted from a host unit; and a light amount control unit that controls emission light amounts of the semiconductor laser elements based on a result from the printing ratio counting unit, wherein the light amount control unit calculates droop correction values corresponding to the printing areas from the printing ratios of the semiconductor laser elements based on the printing ratios in the printing areas counted by the printing ratio counting unit so as to correct the emission light amounts of the semiconductor laser elements, and wherein the light amount control unit has an optical correction table including correction values corresponding to the printing ratios in the scanning direction of the semiconductor laser elements; correction values corresponding to total printing ratios in which the printing ratios of the semiconductor laser elements are summed for each of the printing areas; accumulative printing-ratio area correction coefficients in which the printing ratios of the prior printing areas in a beam scanning direction are accumulated, and determines the droop correction values for the corresponding printing areas of the semiconductor laser elements based on information of the optical correction table, thereby emitting beams from the semiconductor laser elements.

6. The multi-beam image forming apparatus according to claim 5, wherein the droop correction values are products of the accumulative printing-ratio area correction coefficients and values obtained by adding the correction values corresponding to the printing ratios of the semiconductor laser elements to the correction values corresponding to the total printing ratios in which the printing ratios of the semiconductor laser elements are summed for each of the printing areas.

* * * * *